US006470789B1

(12) United States Patent
Hirano

(10) Patent No.: US 6,470,789 B1
(45) Date of Patent: Oct. 29, 2002

(54) DUAL STROKE CYLINDER

(75) Inventor: Akihiro Hirano, Tsukuba-gun (JP)

(73) Assignee: SMC Corporation, Tokyo (JP)

( * ) Notice: Subject to any disclaimer, the term of this patent is extended or adjusted under 35 U.S.C. 154(b) by 41 days.

(21) Appl. No.: 09/713,193

(22) Filed: Nov. 16, 2000

(30) Foreign Application Priority Data

Dec. 10, 1999 (JP) ..... 11-351820

(51) Int. Cl.[7] ..... F01B 7/10
(52) U.S. Cl. ..... 92/65; 91/170 R
(58) Field of Search ..... 92/13.1, 13.6, 92/65; 91/170 R, 508

(56) References Cited

U.S. PATENT DOCUMENTS 2,484,603 A * 10/1949 Audemar et al. ..... 91/167 R
4,593,606 A * 6/1986 Klatt et al. ..... 92/52
4,733,601 A * 3/1988 Neirynck ..... 91/374
5,067,323 A * 11/1991 Bennett et al. ..... 60/734

* cited by examiner

*Primary Examiner*—Edward K. Look
*Assistant Examiner*—Michael Leslie
(74) *Attorney, Agent, or Firm*—Oblon, Spivak, McClelland, Maier & Neustadt, P.C.

(57) ABSTRACT

A first piston 13A and a second piston 13B are disposed in a cylinder tube 12A, a hollow piston rod 17 is connected to the second piston 13B, an intermediate stop rod 16 which penetrates the second piston 13B and is fitted into the piston rod 17 is connected to the first piston 13A, a stopper 19 with which the second piston 13B engages is disposed at the tip of the intermediate stop rod 16, and cylinder chambers 14A, 14B and 14C are formed respectively between the first piston 13A and the head cover 12B, between both pistons 13A and 13B, and between the second piston 13B and the rod cover 12C.

4 Claims, 3 Drawing Sheets

RELATED ART

DUAL STROKE CYLINDER

TECHNICAL FIELD

The present invention relates to a dual stroke cylinder in which a piston rod can be stopped in an intermediate position of the stroke.

PRIOR ART

A normal hydrostatic pressure cylinder is so constructed that a piston rod thereof moves from the starting end to the termination of the stroke all at once. However, there is a demand according to the operation contents for stopping the piston rod in an intermediate position of the stroke, performing some operations during the stroke up to that position, and moving the piston rod again up to the termination of the stroke to perform an operation for the next stage. Moreover, energization of a solenoid valve for controlling the hydrostatic pressure may be cut off due to an unforeseen situation. In that case, with a normal hydrostatic pressure cylinder, a part of an operator's body may be put between work pieces mounted on the rod, at the starting end or termination of the stroke of the piston rod. As a safety measure for preventing such a problem, it is more effective to use a hydrostatic pressure cylinder which can be stopped in an intermediate position and designate the intermediate stop position as a non-energized origin, than a method using a lock mechanism or a three position valve.

FIG. 6 shows one example of a dual stroke cylinder already proposed by the present applicant, in which a piston rod can be stopped in an intermediate position of the stroke. This dual stroke cylinder 1 comprises: a cylinder tube 2A, a first piston 3A sliding airtightly in the cylinder tube 2A; an annular second piston 3B sliding airtightly in the cylinder tube 2A on the rod side of the first piston 3A; a hollow piston rod 7 integral with the second piston 3B; a head cover 2B; and a rod cover 2C.

Inside the cylinder tube 2A, there is provided a stopper rod 6 for setting the stroke of the first piston 3A, which penetrates the center of the first piston 3A so that it can slide freely and airtightly, with one end thereof being fitted to the head cover 2B.

Moreover, the hydrostatic pressure cylinder 1 comprises: a first port 5A for supplying a pressure fluid to a first cylinder chamber 4A on the head cover 2B side of the first piston 3A; a second port 5B for supplying a pressure fluid to a second cylinder chamber 4B between the first piston and the second piston via the inside of the stopper rod 6; and a third port 5C for supplying a pressure fluid to a third cylinder chamber 4C on the rod cover 2C side of the second piston 3B.

Therefore, when the pressure fluid is supplied from the first port 5A to the first cylinder chamber 4A, the first piston 3A is driven, and at the same time, the second piston 3B and the piston rod 7 pushed thereby are driven in the same direction. When the first piston 3A slides as far as the stopper 6B located at the termination of the stopper rod 6, the first piston 3A stops at a position which is moved to the left by a stroke S1 in the figure, and then the pushed second piston 3B and rod 7 stop in the intermediate position of the stroke.

In this state, when the pressure fluid is supplied from the second port 5B to the second cylinder chamber 4B between the first piston and the second piston, and if the pressure fluid has been introduced into the third cylinder chamber 4C, when the pressure fluid is discharged according to need, the second piston 3B and the rod 7 thereof which are stopped in the intermediate position of the stroke move to the left by the remaining stroke (S2–S1) and stop at the termination position of the driving stroke.

This dual stroke cylinder 1 can stop the rod 7 of the second piston 3B to the intermediate position of the stroke S2. However, since the first piston 3A bumps against the stopper 6B of the stopper rod 6 at the time of stopping in the intermediate position, the stopper rod 6 undergoes an impact force every time the first piston 3A is driven.

Accordingly, it is necessary to give strength to the stopper rod 6 so as to endure the impact force. When the strength of the stopper rod 6 is increased, the diameter of the stopper rod 6 increases, and the inner diameter of the first piston 3A which slides on the outer circumference of the stopper rod 6 also increases. Hence, the area presented to the wind of the first piston 3A decreases by that amount, causing a problem in that the output of the first piston 3A decreases.

Furthermore, if the stopper rod 6 is made large, the rigidity of the stopper rod 6 increases, and hence the stopper rod 6 cannot be bent, and as a result, it becomes necessary to strictly adjust the parallelism of the stopper rod 6 and the cylinder tube 2A.

DISCLOSURE OF THE INVENTION

It is an object of the present invention to solve the problems in the dual stroke cylinder already proposed and to provide a dual stroke cylinder in which a stopper rod is not required.

To achieve the above object, the dual stroke cylinder of the present invention is characterized in that it has: a cylinder tube having a head cover and a rod cover fitted to the opposite ends thereof; first and second two pistons which slide airtightly in the cylinder tube; cylinder chambers respectively partitioned between the first piston and the head cover, between the two pistons, and between the second piston and the rod cover; ports for supplying a pressure fluid respectively to each cylinder chamber; a piston rod with the base end portion being connected to the second piston, and the top end portion penetrating the rod cover airtightly, and extending to the outside of the cylinder tube; a hollow rod for intermediate stop having a stopper at the top end portion, with which the second piston is engaged and stops, with the base end portion being connected to the first piston, and with the top end portion penetrating the second piston so as to be relatively freely movable in the back and forth direction, and going into the inside of the piston rod; a conduit shaft having a fluid passage connecting a hollow portion in the piston rod and the second port inside thereof, with the base end portion being connected to the head cover and airtightly and slidably penetrating the first piston and the rod for intermediate stop, and with the top end portion being located in the hollow portion of the piston rod.

In the present invention, it is preferable to have position adjusting means that can adjust the position of the first piston at a return end along the axis of the piston. This position adjusting means is desirably a bolt screwed into the head cover so as to freely advance and retreat, with the top end protruding into the first cylinder chamber.

In the present invention, the stopper fitted to the top end of said rod for intermediate stop is position-adjustable in the axial direction of the rod for intermediate stop.

In the dual stroke cylinder having the above-described construction, the second piston is slid by means of s pressure fluid supplied from the second port to the second cylinder, and the second piston can be stopped at an intermediate position of the stroke by means of the stopper and the second piston and the rod thereof can be held at that intermediate position. By supplying the pressure fluid from the first port to the first cylinder in that state, the first and second pistons and the piston rod can be moved to the stroke termination position.

DETAILED DESCRIPTION

Figure 1:
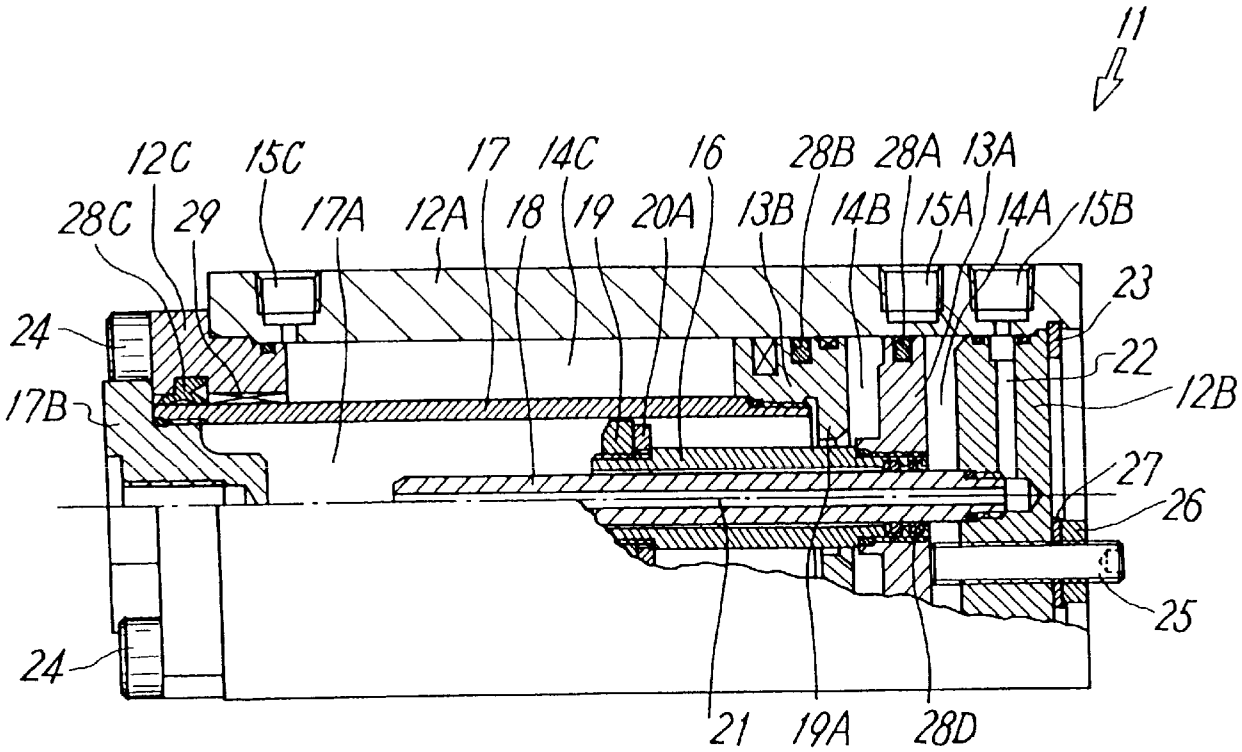
FIG. 1 is a longitudinal elevation view showing a main part in an embodiment of a dual stroke cylinder according to the present invention.
Figure 2:
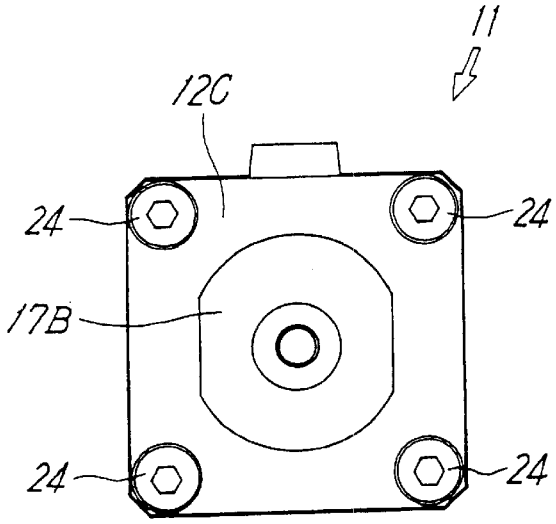
FIG. 2 is a side view on the rod cover side in the embodiment shown in FIG. 1.

FIG. 1 is a longitudinal elevation view showing a main part in an embodiment of a dual stroke cylinder according to the present invention, and FIG. 2 is a side view on the rod side in FIG. 1. The dual stroke cylinder 11 comprises one cylinder tube 12A, and first and second pistons 13A, 13B that slide airtightly in the cylinder tube 12A.

The cylinder tube 12A comprises a head cover 12B airtightly fitted to one end thereof by means of a retaining ring 23, and a rod cover 12C airtightly fixed to the other end thereof by means of a bolt 24.

In the central portion of the head cover 12B, there is screwed one end of a hollow shaft 18 extending in the central portion of the cylinder tube 12A toward the rod cover 12C, and having an axially penetrating passage 21 in the central portion thereof.

The first piston 13A airtightly sliding in the cylinder tube 12A has a tubular rod 16 for intermediate stop extending axially in the central portion thereof. This intermediate stop rod 16 has an external screw portion having a small diameter at the opposite ends, with the one end thereof being screwed airtightly into the central portion of the first piston 13A, and a stopper 19 comprising a nut being screwed into the other end thereof.

The shaft 18 penetrates inside the first piston 13A and the intermediate stop rod 16, a seal member is fitted between the shaft 18 and the first piston 13A, thereby the first piston 13A slides airtightly on the outer circumference of the shaft 18.

Moreover, into the annular second piston 13B is airtightly screwed a base end portion of an annular piston rod 17 having a hollow portion 17A, and the intermediate stop rod 16 and the stopper 19 are fitted into the inside of the piston rod 17 so as to be relatively freely movable in the back and forth direction, as well as the shaft 18 being fitted therein. The top end portion of this piston rod 17 penetrates airtightly the rod cover 12C and reaches outside of the cylinder tube 12A, and the top end portion thereof is blocked up by a rod block 17B. The second piston 13B also comprises an engagement portion 19A wherein the stroke for intermediate stop is set by means of the engagement with the stopper 19.

Moreover, a first cylinder chamber 14A is formed between the head cover 12B and the first piston 13A, a second cylinder chamber 14B communicated with the hollow portion 17A of the piston rod 17 is formed between the first piston 13A and the second piston 13B, and a third cylinder chamber 14C is formed between the second piston 13B and the rod cover 12C.

Then, first, second and third ports 15A, 15B and 15C for supplying compressed air respectively to the first, second and third cylinder chambers 14A, 14B and 14C are established in the cylinder tube 12A, and of these, the first port 15A and the third port 15C are directly communicated with the respectively corresponding cylinder chambers 14A and 14C.

On the other hand, the second port 15B is communicated with the second cylinder chamber 14B via passages 22 and 21 formed inside the head cover 12B and the shaft 18, and the hollow portion 17A in the piston rod 17.

A position restriction bolt 25 for restricting the stop position of the first piston 13A is screwed into the head cover 12B with the top end thereof airtightly penetrating the head cover 12B and protruding into the first cylinder chamber 14A.

A reference symbol 28C in FIG. 1 denotes a packing material for airtightly sealing between the outer circumference of the piston rod 17 and a central hole in the rod cover 12C, 29 denotes a bearing, 28A and 28B denote packing materials for airtightly sealing, respectively, between the first piston 13A and the inner circumference of the cylinder tube 12A and between the second piston 13B and the inner circumference of the cylinder tube 12A. A reference symbol 28D denotes a packing material for airtightly sealing between the first piston 13A and the outer circumference of the shaft 18, 20A denotes a washer disposed on the second piston 13B in a portion where the stopper 19 engages therewith, 26 denotes a nut for locking the position of the position restriction bolt 25 and 27 denotes a sealing member for airtightly sealing the position restriction bolt 25.

The position restriction bolt 25 can advance or retreat by loosening the nut 26, to thereby make the first piston 13A abutting against the position restriction bolt 25, the intermediate stop rod 16 and the stopper 19 advance or retreat in the axial direction of the cylinder tube 12A, thereby enabling adjustment of the intermediate stop position of the piston rod 17 which abuts against the stopper 19 and stops.

Moreover, the intermediate stop position of the piston rod 17 may be adjusted by changing the position of the stopper 19 screwed in the external screw portion of the intermediate stop rod 16.

In this case, since a passage for supplying compressed air to the second cylinder chamber 14B between the first piston 13A and the second piston 13B is constituted by passages 22 and 21 respectively disposed in the head cover 12B and the shaft 18, and the hollow portion 17A disposed in the piston rod 17, compressed air can be supplied to the second cylinder chamber 14B, regardless of the intermediate stop position of the piston rod 17.

The operation of the above-described embodiment will now be described with reference to FIG. 3 to FIG. 5.

Figure 3:
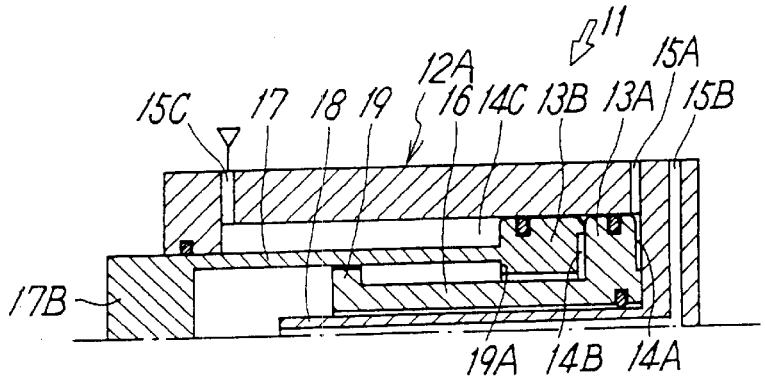
FIG. 3 is a diagram for explaining the operation of the present invention and a schematic sectional view showing a state that a piston rod is located in the termination of the return stroke.

FIG. 3 shows a condition that compressed air is supplied from the third port 15C to the third cylinder chamber 14C, the air in the first and second cylinder chambers 14A, 14B are discharged outside respectively from the first and second ports 15A, 15B, and the first and second pistons 13A, 13B, the intermediate stop rod 16 and the piston rod 17 are at the termination of the return stroke.

In this condition, when the pressure fluid is supplied from the second port 15B to the second cylinder chamber 14B between the first piston 13A and the second piston 13B, since the area presented to the wind of the second cylinder chamber 14B is large, the second piston 13B and the rod 17 thereof are pushed and driven by the pressure fluid.

Figure 4:
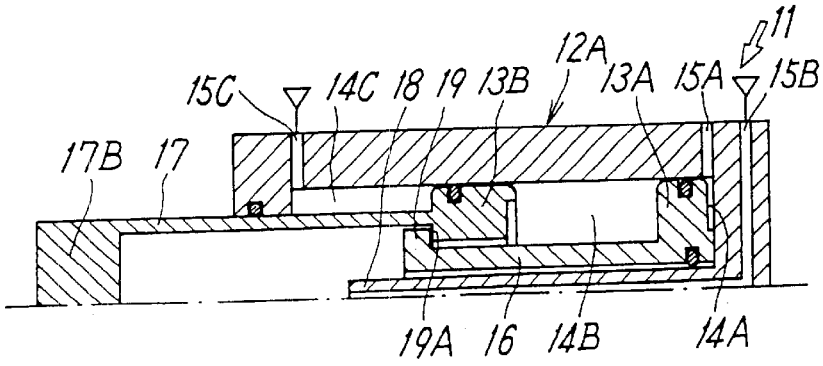
FIG. 4 is a schematic sectional view showing a state that the piston rod is stopped in the intermediate position.

When the second piston 13B slides to the position of the stopper 19, the engagement portion 19A of the second piston 13B bumps against the stopper 19, and hence the second piston 13B and the rod 17 thereof stop in the intermediate position of the stroke (see FIG. 4).

When the second piston 13B reaches the intermediate stop position, the engagement portion 19A bumps against the stopper 19. However, since the pressure fluid in the third cylinder chamber 14C acting on the second piston 13B exerts buffer action, the engagement portion 19A does not bump against the stopper member with a large impact force.

Figure 6:
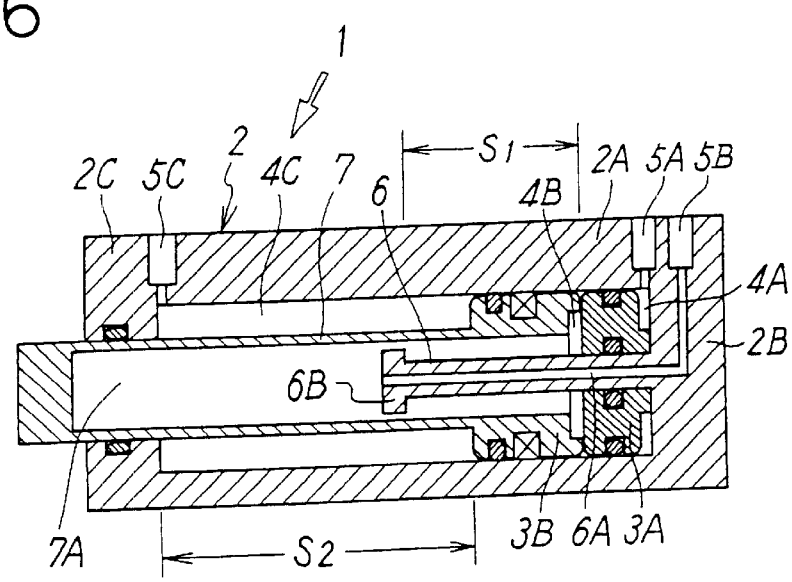
FIG. 6 is a schematic sectional view showing one example of a dual stroke cylinder already proposed.

Moreover, the stopper 19 and the first piston 13A connected thereto are not fixed to the cylinder tube 12A, and the position is held by the hydrostatic pressure. Hence, when the second piston 13B bumps against the stopper 19, the first piston 13A and the second piston 13B do not undergo a large impact force due to the buffer action by means of the fluid, and as a result, the strength can be reduced compared to the conventional example in FIG. 6.

In the above condition, when the pressure fluid is supplied from the first port 15A to the first cylinder chamber 14A disposed on the head side of the first piston 13A, the hydrostatic pressure acts on the first piston 13A. However, since the area presented to the wind on the both faces in the axial direction of the first piston 13A is equal, the first piston 13A is not directly pushed by the pressure fluid in the first cylinder chamber 14A. However, the second piston 13B connected to the first piston 13A via the stopper 19 is pushed by the pressure fluid in the second cylinder chamber 14B, and the pressure fluid pushing the second piston 13B in the return direction is only the pressure fluid in the third cylinder chamber 14C. As a result, the second piston 13B is driven to the termination of the stroke, together with the first piston 13A, due to the difference in the area presented to the wind (see FIG. 5).

When the second piston 13B slides so far as the termination of the stroke, the second piston 13B bumps against the rod cover 12C, and stops at the termination position of the stroke together with the rod 17.

In order to return the rod 17, when the fluid in the first cylinder chamber 14A is discharged to outside, the first and second pistons 13A, 13B and the rod thereof return to the intermediate stop position of the stroke.

Then, when the fluid in the second cylinder chamber 14B is discharged outside, the second pistons 13B and the rod thereof move to the termination of the return stroke due to the hydrostatic pressure in the third cylinder chamber 14C.

Figure 5:
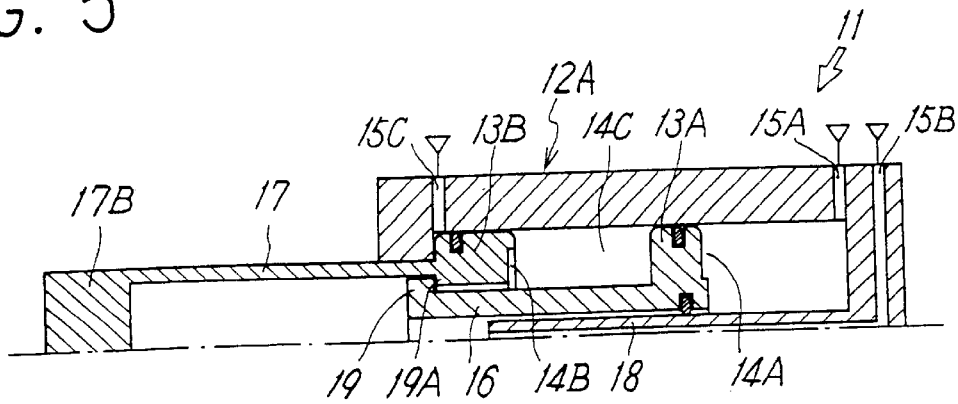
FIG. 5 is a schematic sectional view showing a state that the piston rod is located at the termination in the drive stroke.

If necessary, in the condition of FIG. 5, if the fluid in the first and second cylinder chambers 14A, 14B are discharged outside together, the first and second pistons 13A, 13B and the piston rod 17 thereof move to the termination of the return stroke, without stopping in the intermediate position of the stroke, due to the hydrostatic pressure of the third cylinder chamber 14C.

Moreover, if the position restriction bolt 25 shown in FIG. 1 is made to advance or retreat, the position of the return end of the first piston 13A abutting against the position restriction bolt 25, and hence the position of the return end of the stopper 19 are changed, to thereby change the stop position of the second piston 13B. As a result, the intermediate stop position of the piston rod 17 can be adjusted. In this case, since the pressure fluid is supplied and discharged to/from the second cylinder chamber 14B by the passages 21, 22 disposed in the shaft 18 of the hydrostatic pressure cylinder and the head cover 12B and the hollow portion 17A disposed in the piston rod, even if the intermediate stop position of the piston rod 17 is adjusted, the second port 15B for supplying the compressed air to the second cylinder chamber 14B can be established in a fixed position of the cylinder tube.

With the dual stroke cylinder 11, since the piston rod 17 can be stopped at the intermediate position of the stroke, it ban be utilized for various applications which require intermediate stop. Also, by designating the intermediate stop position as a non-energizing origin, as a safety measure with respect to a case where energization is stopped due to an unforeseen situation, it can be prevented that a part of an operator's body is put between work pieces in the vicinity of the starting end and the termination of the stroke.

In this case, since the intermediate stop position of the piston rod 17 is held by the engagement portion 19A of the second piston 13B abutting against the stopper 19, the stop position is accurate and retention thereof is secured, compared to the retention of the stop position of a piston rod by means of a lock mechanism or the like.

As described above in detail, according to the dual stroke cylinder of the present invention, the second piston and the piston rod connected thereto can be stopped in the intermediate position of the stroke by the stopper, and at that time, since the stopper and the first piston connected thereto are not fixed to the hydrostatic cylinder and the position thereof is held by the hydrostatic pressure, even if the second piston bumps against the stopper, the first piston and the second piston do not undergo a large impact force.

Moreover, even if the second piston bumps against the stopper, the shaft fitted to the head cover of the hydrostatic cylinder, on the outer circumference of which the first piston airtightly slides, does not undergo the impact force. Therefore, the shaft and the head cover do not require large strength. As a result, the diameter of the shaft can be made small, and the head cover can be designed to be thin.

By making the diameter of the shaft small, the inner diameter of the first piston that slides on the outer circumference of the shaft also becomes small. As a result, the area presented to the wind of the first piston can be increased by that amount, and hence even a hydrostatic cylinder having the same size can increase the output of the first piston.

Also, since the shaft does not undergo the impact force, a flexible pipe can be used as a shaft.

If a flexible pipe is used as the shaft, since it is not necessary to strictly adjust the parallelism of the shaft and the cylinder tube, a dual stroke cylinder having a long stroke can be produced. Also, even if the head cover is fitted to the cylinder tube with a slight inclination, since the shaft is flexible, it does not cause any problem in sliding of the first piston.

According to the dual stroke cylinder of the present invention, the stroke of the second piston established by the stopper can be adjusted, and since the stop position of the second piston changes, the intermediate stop position of the piston rod can be adjusted.

What is claimed is:

1. A dual stroke cylinder comprising:

a cylinder tube having a head cover and a rod cover fitted to the opposite ends thereof;

a first piston on the head cover side and a second piston on the rod cover side which slide airtightly in said cylinder tube, the second piston including a center hole;

a first cylinder chamber partitioned between said first piston and said head cover;

a second cylinder chamber partitioned between said two pistons;

a third cylinder chamber partitioned between said second piston and said rod cover;

first, second and third ports for individually supplying pressure fluid respectively to each cylinder chamber;

a piston rod having a hollow portion, the piston rod including a piston base end portion being connected to said second piston such that the hollow area communicates with the center hole of the second piston, and a piston top end portion penetrating said rod cover airtightly, extending to the outside of the cylinder tube, and sealed from an exterior of the cylinder tube;

a hollow rod for intermediate stop having a stopper at the top end portion, with which said second piston is engaged and stopped at a position of a most advancing end, the stopper providing a gap between the stopper and the second piston, with a rod base end portion being connected to said first piston, and a rod top end portion penetrating said second piston so as to be freely movable in the back and forth direction, and going into the inside of said piston rod; and a conduit shaft having a fluid passage connecting a hollow portion in said piston rod and said second port therein, with a shaft base end portion being connected to said head cover and airtightly and slidably penetrating said first piston and said rod for intermediate stop, and with a shaft top end portion extending into said hollow portion, such that fluid delivered to the second port flows through the stopper gap to the second cylinder chamber.

2. A dual stroke cylinder according to claim 1, having position adjusting means which can adjust the position of said first piston at a return end in the back and forth direction along the axis of said piston.

3. A dual stroke cylinder according to claim 2, wherein said position adjusting means is a bolt screwed into said head cover so as to freely advance and retreat, with a bolt top end protruding into said first cylinder chamber.

4. A dual stroke cylinder according to claim 1, wherein said stopper fitted to the top end of the hollow rod for intermediate stop is position-adjustable in the axial direction of the hollow rod for intermediate stop.

* * * * *